US005154364A

United States Patent [19]

Ketting

[11] Patent Number: 5,154,364

[45] Date of Patent: Oct. 13, 1992

[54] GRINDING GAP ADJUSTING DEVICE FOR MILLING ROLLER MILLS

[75] Inventor: Leendert Ketting, Oberuzwil, Switzerland

[73] Assignee: Buehler AG, Uzwil, Switzerland

[21] Appl. No.: 590,335

[22] Filed: Sep. 28, 1990

Related U.S. Application Data

[63] Continuation of Ser. No. 532,353, May 31, 1990, abandoned, which is a continuation of Ser. No. 364,521, Jun. 9, 1989, abandoned, which is a continuation of Ser. No. 833,382, filed as PCT/EP85/00374, Jul. 26, 1985, abandoned.

[30] Foreign Application Priority Data

Aug. 3, 1984 [CH] Switzerland ..... 03744/84-8
Oct. 31, 1984 [DE] Fed. Rep. of Germany ..... 34398341

[51] Int. Cl.[5] ..... B02C 4/06; B02C 4/38

[52] U.S. Cl. ..... 241/37; 74/625; 241/230

[58] Field of Search ..... 241/37, 230, 231, 232, 241/233, 234; 99/486, 523; 100/47; 72/248; 74/625

[56] References Cited

U.S. PATENT DOCUMENTS

| | | | |
|---|---|---|---|
| 720,932 | 2/1903 | Kennedy | 72/248 |
| 1,686,042 | 10/1928 | Steele | 72/248 |
| 4,295,420 | 10/1981 | Satake et al. | 241/37 X |
| 4,339,083 | 7/1982 | Linzberger et al. | 241/37 |
| 4,438,662 | 3/1984 | Walton et al. | 74/625 |
| 4,527,445 | 7/1985 | Walton | 74/625 |
| 4,746,070 | 5/1988 | Kuster | 241/37 |

FOREIGN PATENT DOCUMENTS

| | | | |
|---|---|---|---|
| 0013023 | 12/1979 | European Pat. Off. . | |
| 2519508 | 9/1975 | Fed. Rep. of Germany . | |
| 3238630 | 10/1982 | Fed. Rep. of Germany . | |
| 3209561 | 9/1983 | Fed. Rep. of Germany . | |
| 153611 | 11/1980 | Japan | 72/248 |
| 1005894 | 3/1983 | U.S.S.R. . | |
| 1192732 | 5/1970 | United Kingdom . | |
| 2040506 | 8/1980 | United Kingdom . | |

*Primary Examiner*—Joseph M. Gorski
*Attorney, Agent, or Firm*—McAulay Fisher Nissen Goldberg & Kiel

[57] ABSTRACT

A grinding clearance adjustment device for milling roller frames is disclosed, in which a casing contains two grinding rollers, one of which is constructed as a pivotable loose roller. Adjustment members, for the rollers are provided, as well as a device for the automatic setting of the grinding clearance by means of a remotely controllable drive motor, the latter being coupled to the adjustment members via transmission means. The motor operates through a clutch. In the preferred embodiment, the adjustment members are constructed as a first closed standard component, which has a lever-transmitted setting part with a longer and a shorter lever arm and which is laterally positioned in the vicinity of the grinding rollers. The drive motor and clutch are constructed as a second closed standard component, which is spaced from the first standard component, and the adjustment forces derived from the drive motor are coupled to the longer lever arm of setting part. In addition, the adjustment members are provided with a manual setting means which can be utilized simultaneously with the automatic, motor adjustment.

2 Claims, 3 Drawing Sheets

GRINDING GAP ADJUSTING DEVICE FOR MILLING ROLLER MILLS

This application is a continuation of application Ser. No. 532,353, filed May 31, 1990 and now abandoned, which is a continuation of application Ser. No. 364,521 filed Jun. 9, 1989 and now abandoned, which in turn is a continuation of application Ser. No. 833,382 filed as PCT/EP85/00374, Jul. 26, 1985 and now abandoned.

TECHNICAL FIELD

The invention relates to a grinding gap adjusting device for milling roller mills, in which a casing contains two grinding rollers, whereof one is constructed as a pivotable loose roller, together with adjusting members and a device for the automatic setting of the grinding gap by means of a remotely controllable drive motor, the latter being coupled to the adjusting members by transmission means, while a clutch is interposed.

PRIOR ART

Special account must be taken of three operating states in grinding gap adjusting devices for milling roller mills. If a large foreign body, such as a screw, enters the grinding gap then the shock pressure which occurs must be immediately absorbed, this generally being carried out with a mechanical overload protection device for the pair of rollers.

The grinding rollers, particularly in the case of grooved rollers, must automatically pass into a disengaged position when there is no material to be ground, because otherwise the two grinding rollers would rub against one another as a result of their different speeds and would damage one another.

Finally, for normal milling or grinding operation, the spacing of the grinding rollers (grinding gap) must be very accurately setable.

Experience has shown that for the setting of the grinding gap, a mechanical grinding gap setting device is superior to other, e.g. corresponding hydraulic setting devices. The grinding gap adjustment milling roller mill is a very complex overall process, although the actual adjustment process per se is simple and this is apparent from the statements made in European Patent 13 023. Thus, it has hitherto not been possible e.g. to satisfactorally determine definite parameters (such as the grinding pressure or motor power consumption), which would be suitable as starting parameters for the automatic setting of the grinding gap (roller gap) in accordance with the particular requirements. For economic reasons, it was necessary to numerically limit the influencing parameters detectable and required for a regulation. The control and regulating processes perform automatic regulation operations without any direct view from the outside and normally exclude manual actions. If a milling plant is to be controlled in an optimum manner, for all unforeseeable disturbance variables, which can have widely differing causes, the human being ultimately remains an important part of the plant control. Thus, if there is a need for both an automatic regulation and a manual action, it is necessary to accept very complicated equipment.

DISCLOSURE OF THE INVENTION

On the basis of this, the problem of the present invention is to provide a particularly favourable solution for an appropriate automation of the grinding gap while maintaining the possibility of manual action in connection with milling roller mills.

According to the invention this is achieved in the case of a device of the aforementioned type in that the adjusting members form a first closed standard component having a lever-transmitted part with a longer and a shorter lever arm and laterally arranged in the vicinity of the grinding rollers, that the drive motor and clutch are constructed as a second standard component, installed in spaced manner from the first standard component, the adjusting forces derived from the drive motor acting on the drive motor acting on the longer lever arm of the setting part and that the adjusting members are additionally provided with a manual setting means.

Whereas the hitherto known solutions for automatically operable milling roller mills it has been assumed that, also from the constructional standpoint, the automatic means must be given priority over the means for a manual action, in such known solutions generally a geared motor has been directly connected to tension members for setting the grinding rollers (cf e.g. FIG. 6 of European Patent 13 023). However, in the solution of the present invention the traditional setting means have been combined as an independent, closed subassembly and it was very soon found that the path taken by the invention was extremely advantageous and led to a surprising number of advantages. The inventive solution has revealed that the replacement of the hitherto known manual setting by an automatic setting means need not lead to a new type of grinding, e.g. by a "harder" or "softer" control of the rollers and the like. In fact the invention retains the stability of the setting of the grinding rollers.

Thus, the device according to the invention represents an addition to a rolling mill, which can be fitted at any subsequent time, e.g. if only part of the frame of a roller mill is to be provided with an automatic means. As a milling roller mill already constitutes a very compact machine for the type of operation (processing of flour-type products), accessibility to the remaining components is not made more difficult by the inventive arrangement of a second subassembly at a distance from the grinding roller pair. If necessary, the rolling mill can be operated without the automatic means via the manual setting of the adjusting members.

In a very advantageous embodiment of the invention, the clutch is constructed as an adjustable slip clutch, which permits an automatic grinding roller adjustment means on the basis of given setpoints or desired values, e.g. the clearance between the grinding rollers. The setting can take place on the basis of a predetermined program or setpoint diagram. As faults and disturbances are unavoidable under practical conditions, the slip clutch limits incorrect action. It also makes it possible to prevent the setting of e.g. the grinding gap, or pressure to undesirably high values, so that the rolling mill or roller bearings could be destroyed.

It has proved very advantageous if a first standard component is provided at both bearing ends of the grinding rollers, together with a second standard component common to both bearing ends and further means for the automatic parallel adjustment of the loose roller, the first standard component being controllable by the second standard component via a slipless transmission. This permits a particularly simple, subsequent attachment to existing roller mills which are already in operation, so that it is possible to achieve the greater economics inherent therein on all existing milling roller mills and the latter can also be subsequently equipped for further automation, without it being necessary to provide new roller mills.

A further advantageous development of the invention with respect to ease of operation comprises the drive motor driving an adjusting spindle by the transmission means, such as a chain, said spindle engaging on the longer lever arm of the setting part which, in particularly preferred manner, is more than three times as long as the shorter lever arm and to which is fitted a hand adjustment wheel, which is preferably provided with an indicating device in the form of an indicator clock. Preferably the hand adjustment wheel is provided with an indicating device or a position indicator which is once again preferably constructed in the form of an indicator clock, which as a dial gauge can be directly constructionally integrated into the hand wheel. Thus, for each automatic correction, the hand wheel is correspondingly moved along and the particular position is indicated thereon. It is particularly advantageous if the second standard component is positioned in the vicinity of the roller mill base.

A further advantageous development of the grinding clearance adjustment device according to the invention comprises providing a position indicator, which is controllable by the transmission means or by the adjustment members. Preferably such a position indicator is constituted by a potentiometer. Particularly advantageously the transmission means transmit the adjusting force by a slipless transmission, the position indicator being coupled directly via a chain either to the slipless transmission or to the driven side of the clutch. The slipless transmission is preferably constituted by a toothed belt, a chain or similar means, which simultaneously move the position indicator.

The position indicator, which is preferably connected to a suitable position indication means, at all times permits an indication and a back indication of the precise position of both grinding rollers, particularly if the position indicator is fitted to the driven side of the clutch, i.e. in a direct forced connection with the adjustment members. In practice, it has proved particularly appropriate for the purpose of controlling the drive motor by the operator, for the position indicator to have a digital display and manual input keys on the roller mill casing. This can lead to an appropriate control of the drive motor by the operator, e.g. the senior miller, if corresponding desired roller position values have been reached.

A further advantageous development of the grinding gap adjustment device according to the invention comprise providing a digital display and manual input keys on the roller mill casing for the control of the drive motor. For the remote control of the drive motor a program-controlled computer is preferably provided and on this preferably superimposed a common computer connected upstream of the computers of several roller mills. However, in certain cases it can be very advantageous not to have an upstream connection or arrangement and instead to associate a common computer with one or more setpoint stores with a plurality of roller mills. These measures permit a direct control of all the roller mills in accordance with predetermined setpoint diagrams, i.e. there is a true control process.

Over and beyond the control process, the grinding clearance adjustment device can also form part of a regulating mechanism and the grinding result or the, particle fineness resulting from the grinding gap width can be chosen as the quantity to be regulated and controlled in accordance with the grinding gap.

Preferably the output signals of a grinding pressure measuring device and/or a pressure threshold switch associated with the grinding rollers can be applied to the input of said computer. As desired, either a pressure threshold switch and/or a position threshold switch can be used for overload protection purposes in those fault cases caused by incorrect control instructions for the setting of the grinding clearance. Preferably the output signals of a power requirement measuring device and/or a power consumption threshold switch associated with the grinding rollers are applied to the computer input. However, the output signals of a roller clearance measuring device and/or a clearance threshold switch associated with the grinding rollers can also be applied to the computer input. It is also advantageous if a safety element setable to selectable limit values for the grinding pressure or power requirement or roller gap is simultaneously effectively provided both for the motor and the manual setting mechanism.

SHORT DESCRIPTION OF THE DRAWINGS

The invention is described in exemplified manner hereinafter relative to the drawings, wherein show:

FIG. 1, a grinding gap adjustment device of a milling roller mill according to the invention with adjustment means.

FIG. 2, a diagrammatic front view of a roller mill according to FIG. 1, which has on either side both motor and manual settings.

FIG. 3, another embodiment with respect to that shown in FIG. 2, but with two-sided manual setting and only one motor drive for a parallel adjustment of the grinding rollers.

FIG. 4, a diagrammatic representation of the motor adjustment and also computer means (computer) of a grinding gap adjustment device according to the invention.

DETAILED DESCRIPTION OF THE DRAWINGS

Figure 1:
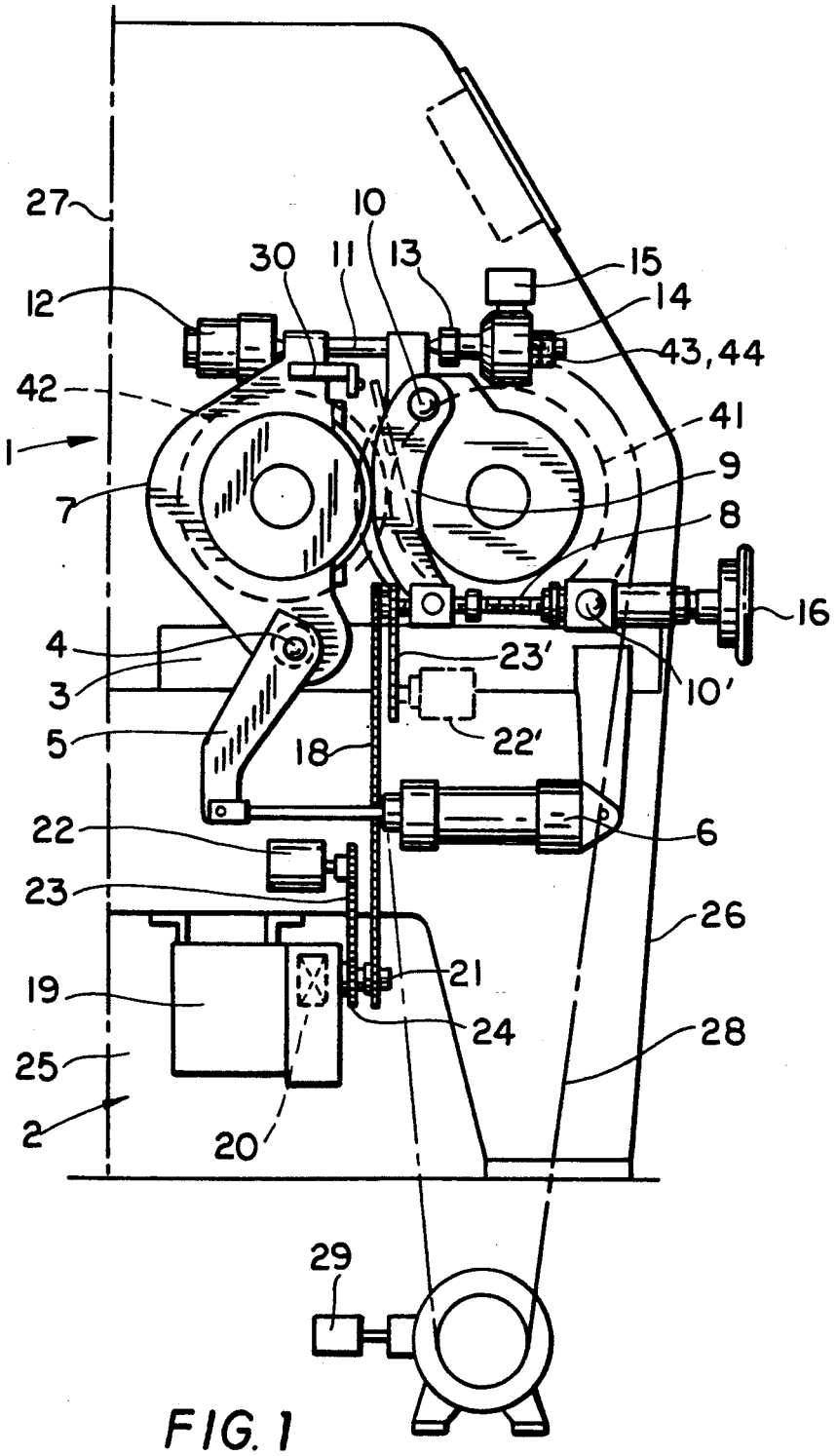

FIG. 1 shows a milling roller mill with adjustment members as a subassembly 1 and with a controllable adjustment drive as a second subassembly 2. Two grinding rollers 41, 42 are supported on a common support 3. Loose roller 42 is pivotably fixed to a fixed eccentric stud 4, the engagement and disengagement being controlled by a lever 5 and a disengaging cylinder 6. As a result of the pivoting movement of lever 5, the eccentric stud 4 is rotated and leads to a horizontal displacement of the lower part of the pivotable bearing box 7, so that a rough setting of the clearance of the two grinding rollers is possible. However, this device would be too inaccurate for a precise setting and it is consequently only used for bringing the grinding rollers 41, 42 into an engaged or disengaged position or into two fixed positions. The actual fine setting is brought about by means of an adjusting spindle 8, which by rotation directly moves a setting arm 9 about a fixed pivot bearing 10. The upper, shorter lever arm of setting arm 9 is non-positively connected with the pivotable bearing box 7 via a tie rod 11. Force transmission takes place by means of cutting edges, which on one side form part of a spring overload protection device 12. On the other side an adjustable retaining button 13 and a pressure meter 14 with pressure indicator 15 are provided on tie rod 11. To permit a parallel setting of the grinding rollers when carrying out servicing, it is possible to carry out a correction on the necessary side by means of setscrews 43, 44. The adjusting spindle 8 is held fixed by bearing 10' and can now be operated by a hand wheel 16, which has a directly installed indicator clock 17 (FIG. 2), or by motor means, namely a transmission chain 18, as well as a geared or drive motor 19. Drive motor 19 is fixed to the roller mill 26 and is directly connected with the transmission chain 18 or adjustment spindle 8 by means of a slip clutch 20 and a sprocket 21.

However, the adjustment motor 19 and slip clutch 20 could also be fixed to any other appropriate point, e.g. to the outside of the rolling mill. The free inner space of the column base is, however, the most suitable point for the location of the adjustment drive with a view to optimising the overall conditions. Slip clutch 20 can be constituted by any suitable slip clutch, which transmits minimum torques and which at a given preselectable torque can release by slipping the forced connection or no longer transmits the adjustment force of the motor means extending beyond a given torque. However, the minimum torque must only be sufficiently large that it can be overcome with the hand wheel 16 and consequently a grinding gap setting can be brought about without any manual rotation of geared motor 19.

A position indicator 22 is directly connected with transmission chain 18 via a chain 23 and a sprocket 24, so that any movement of transmission chain 19 is recorded in position indicator 23 and is passed on to the desired points. As can be gathered from FIGS. 1 and 2, very few individual components are required for the motor adjustment means. The major component, the drive motor 19 and clutch 20 are preferably arranged in the vicinity of a lower, free recess in the roller mill stand 26, so that it is possible at any time to attach the second subassembly to all the automatic grinding clearance setting means to correspondingly constructed, older milling roller mills. If suitably designed, the subassembly can be constructed in the form of a closed standard component, so that the subsequent installation is further facilitated and accelerated. As milling roller mills are generally constructed in duplicated form, this is indicated in FIG. 1 by a dot-dash axis 27. Each roller pair of the two mill halves may or may not be equipped with such automatic adjustment means.

Figure 2:
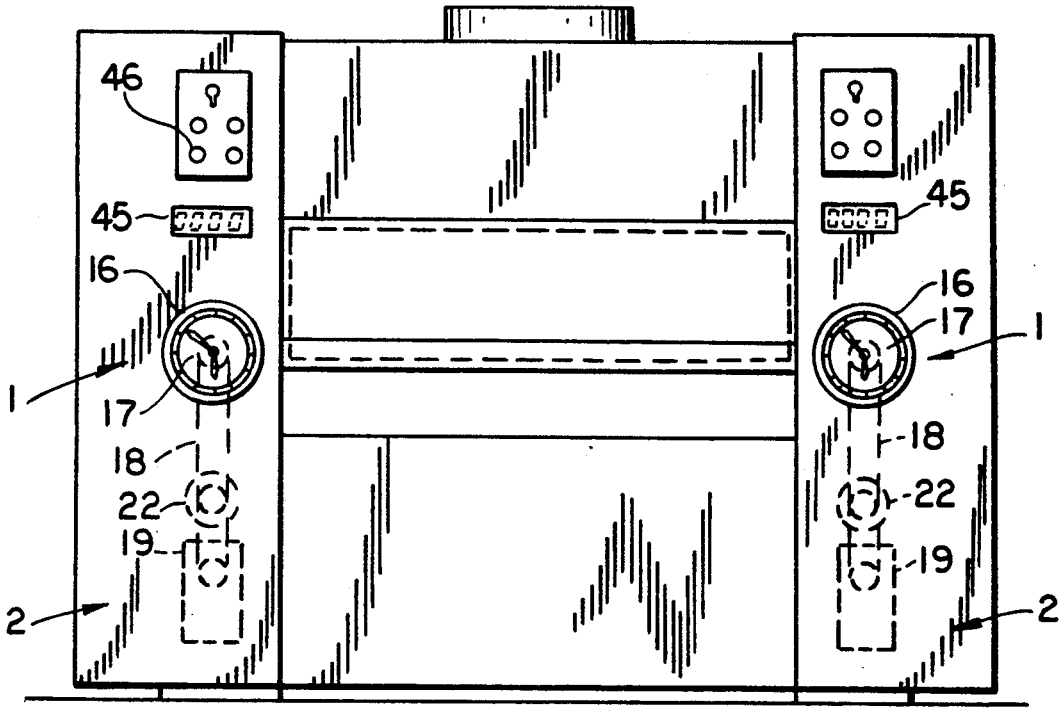

In the case of the embodiment shown in FIG. 2, there is a subassembly 1 and 2 on either bearing end. It is also possible to place on either end a hand wheel 16 with an integrated indicator clock 17. Both bearing ends or sides are in each case provided with a drive motor 19, a position indicator 22 and a transmission chain 18. Thus, on both bearing sides the roller clearance can be controlled by means of motor 19 and chain 18 or can be set by the operator using hand wheel 16. Indicator clock 17 could be replaced by a digital display 45 and manual input keys 46. It would also be conceivable that for a certain starting period hand wheel 16 and manual input keys 45 could simultaneously be provided for acquainting the operating personnel. It is also possible to provide the digital display 45 or indicator clock 17 either alone or simultaneously, which may be advantageous in certain cases.

Figure 3:
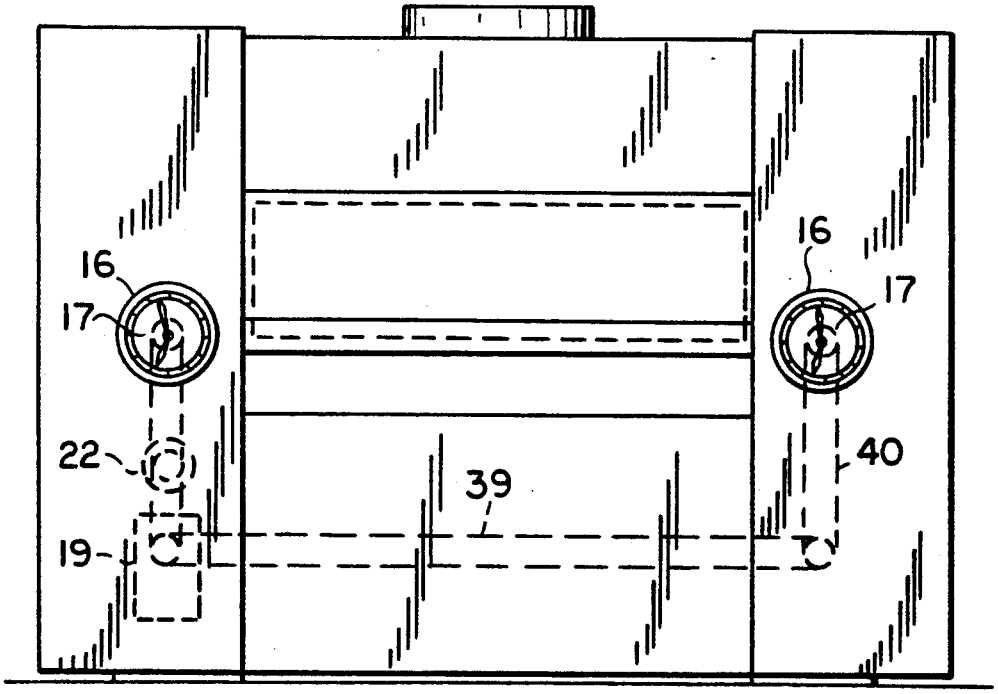

FIG. 3 is an alternative to the embodiment of FIG. 2 and in it only hand wheel 16 and indicator clock 17 are provided in duplicated form to the left and right for an individual correction. In a further simplification, there need only be a single hand wheel 16 in place of the left and right-hand hand wheels. A necessary correction on one side can take place by means of nuts 43, 44 (FIG. 1), so that only one hand wheel 16 with indicator clock 17 is required e.g. in the case of large mills where there is rarely a change to the product mixture or which always have the same end products. The setting of the grinding clearance also takes place by means of a drive motor 19 in the case of FIG. 3, the adjustment path transferred via a chain 39 or 40 to the other bearing side. Using the corresponding automatic means, this permits a parallel adjustment of the grinding rollers.

FIG. 1 shows a drive 28 for grinding rollers 41 and 42 (shown in dot-dash line manner). An electrical power requirement measuring and indicating device 29 can also be provided in the drive system. Thus, e.g. the electrical power consumption can be limited to upper and lower values and on exceeding the preselected range, e.g. the grinding rollers are disengaged.

Another possibility consists of the effective spacing of the bearing box parts being determined by means of a roller clearance measuring and indicating device 30 (cf FIG. 1). Particularly when using grooved rollers, the roller clearance monitoring means very simply prevents incorrect instructions or commands which would lead to the mechanical destruction of at least certain parts of the rolling mill.

Figure 4:
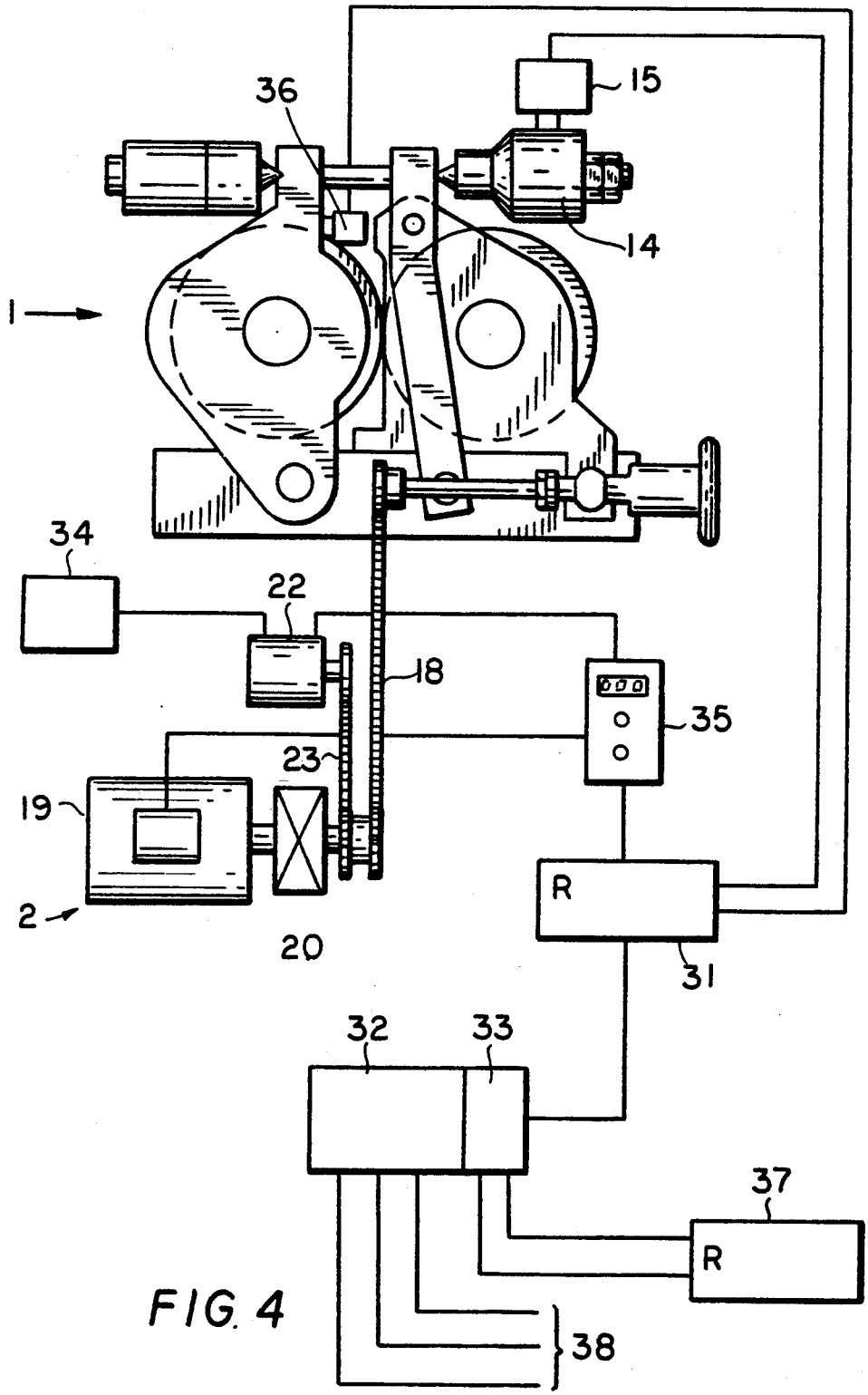

FIG. 4 once again shows such a device diagrammatically, supplemented by further control linkages. All the signals of a roller mill are coordinated and controlled by means of a computer 31 in FIG. 4, whereby said computer can poll the necessary desired or set values from a central computer 32 with store 33. In FIG. 4, position indicator 22 is also equipped with a position threshold switch 34, which can be set to desired thresholds, so as to prevent an incorrect setting by the automatic means. In the represented position, the position threshold switch 34 has the advantage that it is also possible to prevent an incorrect manual setting because the hand wheel and also the automatic adjustment means lead to a corresponding path displacement of transmission chain 18 and chain 23. In the same way as adjustment motor 19, position indicator 22 can be connected to an input—output device 35, which receives or supplies corresponding signals with respect to computer 31, corresponding to the digital display 45 and manual input keys 46 in FIG. 2. In the same sense, the pressure measuring and indicating device 14, 15 can be connected to computer 31. As a function of the degree of development of a rolling mill, it is possible to provide one more protection means on the same mill. If e.g. grooved rollers are fitted, grinding pressure monitoring is less appropriate, but monitoring the clearance of the grinding rollers via position indicator 22 or spacing measuring means 36 is advantageous. The opposite conditions prevail in the case of smooth rollers, where pressure monitoring leads to great advantages. The computer 37 and signal lines 38 in FIG. 4 indicate that the computer 32 with its memory or store 33 can control a plurality and possibly even all the roller mills in a mill and can, if necessary, coordinate regulating functions.

It has proved particularly advantageous if the digital display 45 provides readings in the same manner of value representation as the hand wheel indication, e.g. values according to a time representation on a clock (e.g. hand wheel is at position 15.30 hours and the digital display also shows 15.30 hours).

A further important advantage is that the impiricle values of non-automated or non-remotely controllable roller mills are useable in compared form for producing or improving corresponding control programs.

I claim:

1. In a grinding gap adjustment device for grain milling roller mills of the type including two grinding rollers, adjustment members for adjusting the distance between the rollers to set the members for adjusting the distance between the rollers to set the grinding gap, and means for automatically setting the grinding gap by means of a remotely controllable drive motor coupled by transmission means to said adjustment members, the improvement comprising: said transmission means including a slipless transmission element for providing a precise positional relationship between said means for automatically setting and said adjustment members;

said adjustment members forming a first subassembly having a lever-transmitted setting assembly with at least one lever arm positioned proximate the grinding rollers;

slip clutch means coupling said drive motor to said transmission means and being combined with said drive motor in a second subassembly fitted within the roller mill at a distance from the first subassembly;

a first subassembly and a second subassembly being arranged at each end of the grinding rollers; and manual setting means mechanically coupled to at least one of said adjustment members, said slip clutch means of each second subassembly being constructed to slip when the manual means is operated, so that manual adjustment and automatic setting of the grinding gap can be made independently at both ends of the grinding rollers, said first and second subassemblies capable of being readily added to or removed from a roller mill as a unit; wherein said slipless transmission element includes a chain; and a position indicator for allowing the precise position of both grinding rollers to be determined by a user, said position indicator being coupled by a chain to one of the transmission means and the driven side of the clutch means.

2. In a grinding gap adjustment device for rain milling roller mills of the type including two grinding rollers, adjustment means for setting the distance between the rollers to set grinding clearance, and means for automatically setting the grinding clearance by means of a remotely controllable drive motor coupled by transmission means to said adjustment means, the improvement comprising:

said transmission means including a slipless transmission element for providing a precise positional relationship between said means for automatic setting and said adjustment members;

said adjustment means including an adjustment member for adjusting the grinding clearance between the rollers;

slip clutch means coupling said drive motor to said transmission means;

manual setting means mechanically coupled to said adjustment means through said transmission means, said slip clutch means being constructed to slip when the manual setting means is operated so as to apply a preselected minimum torque to said slip clutch so that manual adjustment and automatic setting of the grinding gap can be made independently; and said adjustment means forming a first subassembly including a lever transmitted setting assembly with at least one lever arm positioned proximate the grinding rollers and said slip clutch being combined with said drive motor in a second subassembly fitted within the roller mill at a distance from said first subassembly; wherein said first and second subassemblies are capable of being readily added to or removed from a roller mill as a unit; wherein said slipless transmission element includes a chain; and a position indicator for allowing the precise position of both grinding rollers to be determined by a user, said position indicator being coupled by a chain to one of the transmission means and the driven side of the clutch means.

* * * * *